US010340130B2

(12) United States Patent
Chang

(10) Patent No.: US 10,340,130 B2
(45) Date of Patent: Jul. 2, 2019

(54) DATA INDEPENDENT ACQUISITION WITH VARIABLE MULTIPLEXING DEGREE

(71) Applicant: Thermo Finnigan LLC, San Jose, CA (US)

(72) Inventor: James S. Chang, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 265 days.

(21) Appl. No.: 15/475,663

(22) Filed: Mar. 31, 2017

(65) Prior Publication Data

US 2017/0287687 A1 Oct. 5, 2017

Related U.S. Application Data

(60) Provisional application No. 62/318,603, filed on Apr. 5, 2016.

(51) Int. Cl.
*H01J 49/00* (2006.01)
*H01J 49/42* (2006.01)

(52) U.S. Cl.
CPC ..... *H01J 49/0036* (2013.01); *H01J 49/004* (2013.01); *H01J 49/4215* (2013.01)

(58) Field of Classification Search
CPC ..... H01J 49/0027; H01J 49/0031; H01J 49/0036; H01J 49/004; H01J 49/0045; H01J 49/005; H01J 49/42; H01J 49/4215; G01N 33/6848
See application file for complete search history.

(56) References Cited

U.S. PATENT DOCUMENTS 7,880,136 B2 2/2011 Makarov et al.
8,809,770 B2 8/2014 Bonner et al.
8,809,772 B2 8/2014 Bonner et al.
9,202,677 B2 12/2015 Tate et al.
(Continued)

FOREIGN PATENT DOCUMENTS

WO 2007/030948 A1 3/2007
WO 2015/068001 A1 5/2015
(Continued)

OTHER PUBLICATIONS

Egertson et al., "Multiplexed MS /MS for improved data independentacquisition", Nature Methods, 2013, vol. 10 (8), pp. 744-748.

(Continued)

*Primary Examiner* — David E Smith
(74) *Attorney, Agent, or Firm* — Charles B. Katz

(57) ABSTRACT

A method is disclosed for analyzing ions by mass spectrometry by repeatedly executing a data acquisition cycle to acquire product ion data across a precursor mass range of interest. The data acquisition cycle comprises performing, for each of a plurality of isolation windows having different mass ranges, steps of (i) isolating precursor ions within the mass range of the isolation window, (ii) fragmenting the isolated precursor ions to generate product ions, and (iii) mass analyzing the product ions. The step of mass analyzing the product ions includes concurrently mass analyzing product ions corresponding to N isolation windows, N being an integer greater than or equal to one, wherein N is changed at least once across the data acquisition cycle.

19 Claims, 3 Drawing Sheets

(56) References Cited

U.S. PATENT DOCUMENTS

| | | | | |
|---|---|---|---|---|
| 2013/0240723 | A1* | 9/2013 | Bonner | H01J 49/0045 250/282 |
| 2015/0025813 | A1* | 1/2015 | Collings | H01J 49/0031 702/24 |
| 2016/0005581 | A1* | 1/2016 | Graichen | G01N 27/622 250/282 |
| 2016/0233077 | A1* | 8/2016 | Hager | H01J 49/4215 |

FOREIGN PATENT DOCUMENTS

| | | | |
|---|---|---|---|
| WO | 2015/097504 | A1 | 7/2015 |
| WO | 2016/011355 | A1 | 1/2016 |

OTHER PUBLICATIONS

Venable et al., "Automated approach for quantitative analysis ofcomplex peptide mixtures from tandem mass spectra", Nature Methods, 2004, vol. 1 (1), pp. 1-7.

* cited by examiner

DATA INDEPENDENT ACQUISITION WITH VARIABLE MULTIPLEXING DEGREE

CROSS-REFERENCE TO RELATED APPLICATION

This application claims the priority benefit under 35 U.S.C. § 119(e)(1) to U.S. provisional patent application Ser. No. 62/318,603 for "Data Independent Acquisition with Variable Multiplexing Degree", filed Apr. 5, 2016, the disclosure of which is incorporated herein by reference in its entirety.

FIELD OF THE INVENTION

The present invention relates generally to mass spectrometry, and more specifically to methods of operating a mass spectrometer for data independent acquisiton.

BACKGROUND OF THE INVENTION

Data independent acquisition (DIA) is a mass spectrometry technique in which MS/MS data is acquired for substantially all precursor ions across a mass (m/z) range of interest. An implementation of DIA is symbolically depicted in FIG. 1. Within an acquisition cycle, an isolation window is stepped across a mass range of interest in a series of MS/MS events. For each MS/MS event, ions within a mass window are isolated (i.e., mass selected), fragmented (e.g., by collisionally activated dissociation), and an MS/MS spectrum is acquired of the resultant product ions. The isolation windows are set such that they sequentially span the precursor ion mass range of interest. In the example depicted, the precursor range of interest is 500-1000 Thomson (m/z units, abbreviated Th), and 25 isolation windows of 20 Th width are used. After the isolation window has been stepped across the entire range of interest, the acquisition cycle is repeated. As depicted in FIG. 1, each acquisition cycle may be initiated by a full range MS scan (a "survey scan") to obtain a spectrum of the precursor ions. DIA has the advantage of producing a rich data set without requiring a priori knowledge of targets, and the data set can be revisited to investigate hypotheses generated post-acquisition.

The selection of the isolation window width in DIA involves balancing competing performance considerations. In general, using narrower window widths reduces the number of different precursor ion species fragmented together in an MS/MS event, rendering the resultant product ion spectra relatively clean and easy to interpret (noting that since each MS/MS spectra will typically include ions from a number of precursor ion species, some sort of deconvolution to assign product ions in the spectra to a corresponding precursor ion species will typically be required). However, because the number of MS/MS events in a DIA cycle is inversely proportional to the window width, each DIA cycle will take a relatively long time to complete when narrow window widths are utilized. This reduces the number of DIA cycles that can be completed across a chromatographic peak, which in turn compromises the ability to reliably and accurately quantify sample components, particularly when elution peaks are narrow. Conversely, wide isolation windows permit a relatively large number of acquisition cycles to be performed across a chromatographic peak, but the resultant MS/MS spectra are highly complex and difficult to interpret due to the multiplicity of different precursor ion species present in an MS/MS scan; this complexity may be particularly problematic for samples in the form of a biological matrix such as blood plasma. The selection of an appropriate window width is made more difficult by the fact that precursor ion species produced from a sample will not typically be distributed evenly across the m/z range of interest, and information regarding their distribution may not be available prior to running the analysis.

SUMMARY

Generally described, there is provided a method of analyzing ions by mass spectrometry which includes repeatedly executing a data acquisition cycle to acquire product ion data across a precursor mass range of interest. The data acquisition cycle comprises performing, for each of a plurality of isolation windows having different mass ranges, steps of (i) isolating precursor ions within the mass range of the isolation window, (ii) fragmenting the isolated precursor ions to generate product ions, and (iii) mass analyzing the product ions. The plurality of isolation windows employed for the acquisition cycles span the precursor ion mass range of interest. The step of mass analyzing the product ions includes concurrently mass analyzing product ions corresponding to N isolation windows, N being an integer greater than or equal to one, wherein N is changed at least once across the data acquisition cycle.

One or more of the following features may be practiced in more specific embodiments. The data acquisition cycle may include a step of conducting a survey scan to mass analyze the precursor ions across the precursor mass range of interest. N may be varied at least twice, three times or four times across the acquisition cycle. The plurality of isolation windows may all have the same widths, or two or more of the isolation windows may have different widths. For portions of the data acquisition cycle where N≥2, the least one of the isolation windows may be disjoint with respect to all others of the N concurrently analyzed isolation windows. At least two of the plurality isolation windows may overlap. The plurality of isolation windows may include at least 10 isolation windows. Each of the isolation windows may have a width of at least 5 Thomson (m/z units). Precursor ions of each of the N concurrently analyzed isolation windows may be separately fragmented and subsequently combined, or alternatively, precursor ions of the N concurrently analyzed isolation windows may be fragmented together. For portions of the data acquisition cycle where N≥2, the N concurrently analyzed isolation windows may be selected in a randomized manner. The variation of N across the data acquisition cycle may be set by the operator, or may be set automatically based on previously acquired data.

By enabling the number N of concurrently analyzed isolation windows to be varied across the acquisition cycle, the generation of overly complex product spectra can be avoided in regions of the precursor ion space which are highly populated with precursor ion species (by setting N to a low number for such regions), while maintaining high-throughput in regions of the precursor ion space which are more sparsely populated (by setting N to a higher number for such regions).

BRIEF DESCRIPTION OF THE DRAWINGS

Like reference numerals refer to corresponding parts throughout the several views of the drawings.

DETAILED DESCRIPTION OF EMBODIMENTS

Figure 1:
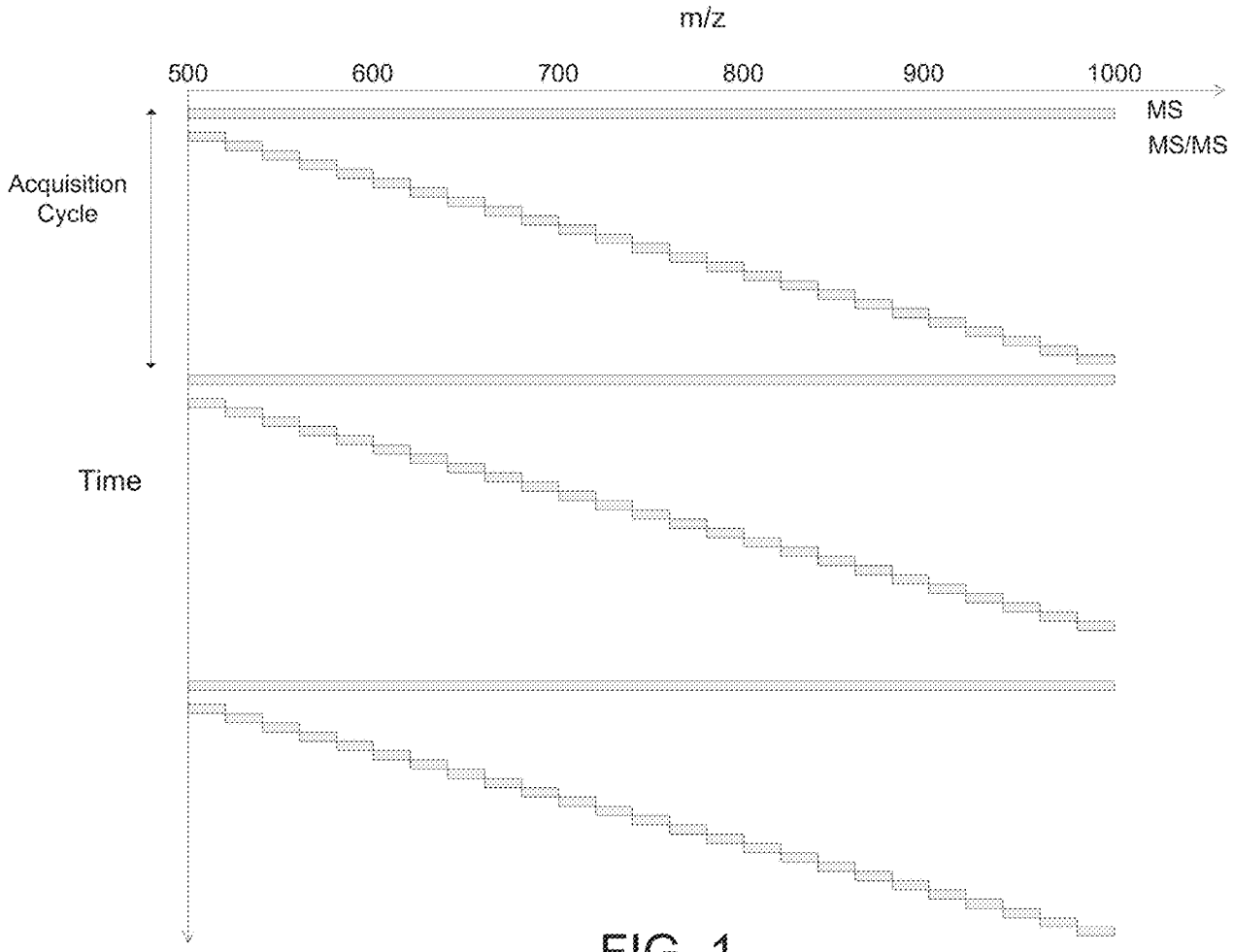
FIG. 1 depicts a conventional acquisition cycle used for DIA.
Figure 2:
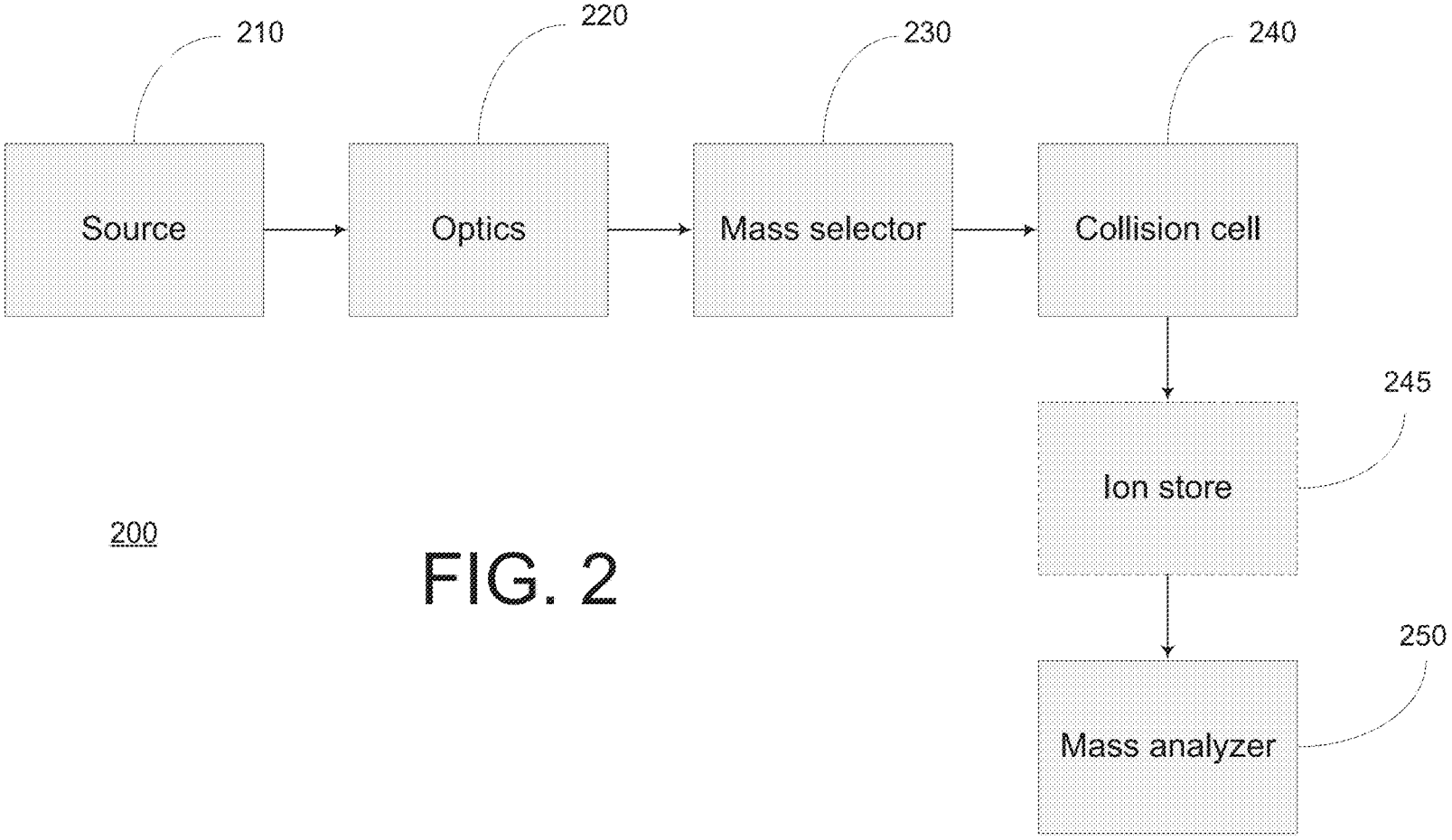
FIG. 2 is a symbolic diagram of components of a mass spectrometer that may be employed to implement methods of the present invention.

As addressed above, embodiments of the present invention remediate the challenges posed by prior art DIA methods by use of a technique in which a number N of concurrently analyzed isolation windows is varied within an acquisition cycle. This technique is colloquially referred to herein as variable degree multiplexing DIA (mDIA). mDIA takes advantage of the multiplexed analysis capability available in certain commercially available mass spectrometer instruments such as the Q Exactive and Orbitrap Fusion mass spectrometers available from Thermo Fisher Scientific. These instruments have the ability to combine product ions produced by two or more isolation/fragmentation sequences, and analyze the combined ions together in a single analytical scan (e.g., the transient acquisition period of an orbital trapping mass analyzer). An instrument 200 of this type is represented generically in FIG. 2. Ions generated in the ion source 210 are delivered by ion optics 220 to a mass selector 230 (e.g., a quadrupole mass filter), which selects ions within a controlled range of m/z's (an isolation window) for fragmentation. Ion source 210 is configured to generate ions from a sample, which may comprise, in one example, the eluate of a liquid chromatography system or other separation device. As is known in the art, the isolation window is set by, in the case of a quadrupole mass filter, adjusting the amplitudes of the radio-frequency (RF) and resolving direct-current (DC) fields applied to the electrodes of the mass filter such that ions having m/z's outside of the isolation window develop unstable trajectories and are not transmitted by the mass filter. The selected ions are then fragmented, for example in a collision cell 240, to generate product ions. The product ions may be confined within collision cell 240 while a subsequent isolation/fragmentation sequence is performed, such that product ions generated from the multiple isolation/fragmentation sequences are accumulated together within collision cell 240.

For example, mass selector 230 may be initially operated to selectively transmit ions within a mass window (also referred to herein as an isolation window) of 500-520 Th into collision cell for fragmentation. The resultant product ions may then be confined within collision cell 240 while mass selector 230 is operated to selectively transmit ions within a mass window of 520-540 Th. The product ions generated from precursors in the first (500-520 Th) mass window are thus combined with product ions generated from precursors in the second (520-540 Th) mass window, and the combined product ions may be transferred to a mass analyzer 250 (e.g., an orbital electrostatic trapping analyzer, of the type sold by Thermo Fisher Scientific under the trademark "Orbitrap") for acquisition of the MS/MS spectrum. The duration of acquisition cycles is reduced in multiplexed analysis by enabling the simultaneous analysis of product ions generated in plural isolation/fragmentation sequences (in comparison to conventional DIA methods, in which a MS/MS spectrum is acquired after each isolation/fragmentation sequence).

It is noted that the accumulation/combination of product ions from multiple isolation/fragmentation sequences may alternatively be performed in an optional ion store 245 located downstream of the collision cell, e.g., the product ions from a first isolation window may be transferred to the downstream ion store, and later combined with product ions from a subsequent isolation window in the downstream ion store. Furthermore, other types of devices, e.g., a quadrupole ion trap, may be utilized to perform the isolation function. In certain mass spectrometer architectures, it may be possible to simultaneously fragment ions from two or more isolation windows. It should be further acknowledged that other fragmentation techniques (e.g., photodissociation, electron transfer dissociation) may be utilized in place of collisionally activated dissociation to generate product ions.

For acquisition of an MS (survey) spectrum where no fragmentation is desired, mass selector 230 may be operated to transmit all ions within a precursor range of interest (e.g., all ions having m/z's between 500-1000), and collision cell 240 may be operated to avoid fragmentation of the precursor ions, e.g., by reducing the kinetic energies of precursor ions entering the collision cell.

In certain implementations of the invention, the duration of the injection time of ions within each isolation window (i.e., the time during which ions within a selected isolation window are delivered to collision cell 240 for fragmentation, or alternatively, to an ion store positioned upstream of collision cell 240) is constant across the acquisition cycle. For example, precursor ions within the 500-520 Th isolation window may be injected into collision cell 240 for an injection time of 5 ms, followed by injection of precursor ions within the 520-540 Th isolation window for 5 ms, and so on. In an alternative embodiment, the injection times may be variable and may differ among the precursor isolation windows; for example, precursor ions within the 500-520 Th isolation window may be injected into collision cell 240 for an injection time of 5 ms, followed by injection of precursor ions within the 520-540 Th isolation window for 10 ms. Variable injection times may be advantageous for experiments in which large variations exist between the abundances of ions in different isolation windows, allowing mass analyzer 150 to be filled with ions to a target population which provides high sensitivity while avoiding the adverse impact on resolution and mass accuracy caused by space charge effects arising from mass analysis of excessively high numbers of ions.

Instrument 200 is also provided with a (not-depicted) data/control system for controlling the operation of the various components, and for storing and processing mass spectral data generated by the mass analyzer. The functions of the data/control system will typically be distributed across several devices, including general-purpose and specialized processors, memory, storage devices, and input/output devices such as video displays, keyboards, and mice. The data/control system will typically be programmed with software code for performing the steps of a data acquisition method, such as the methods that are disclosed herein.

Figure 3:
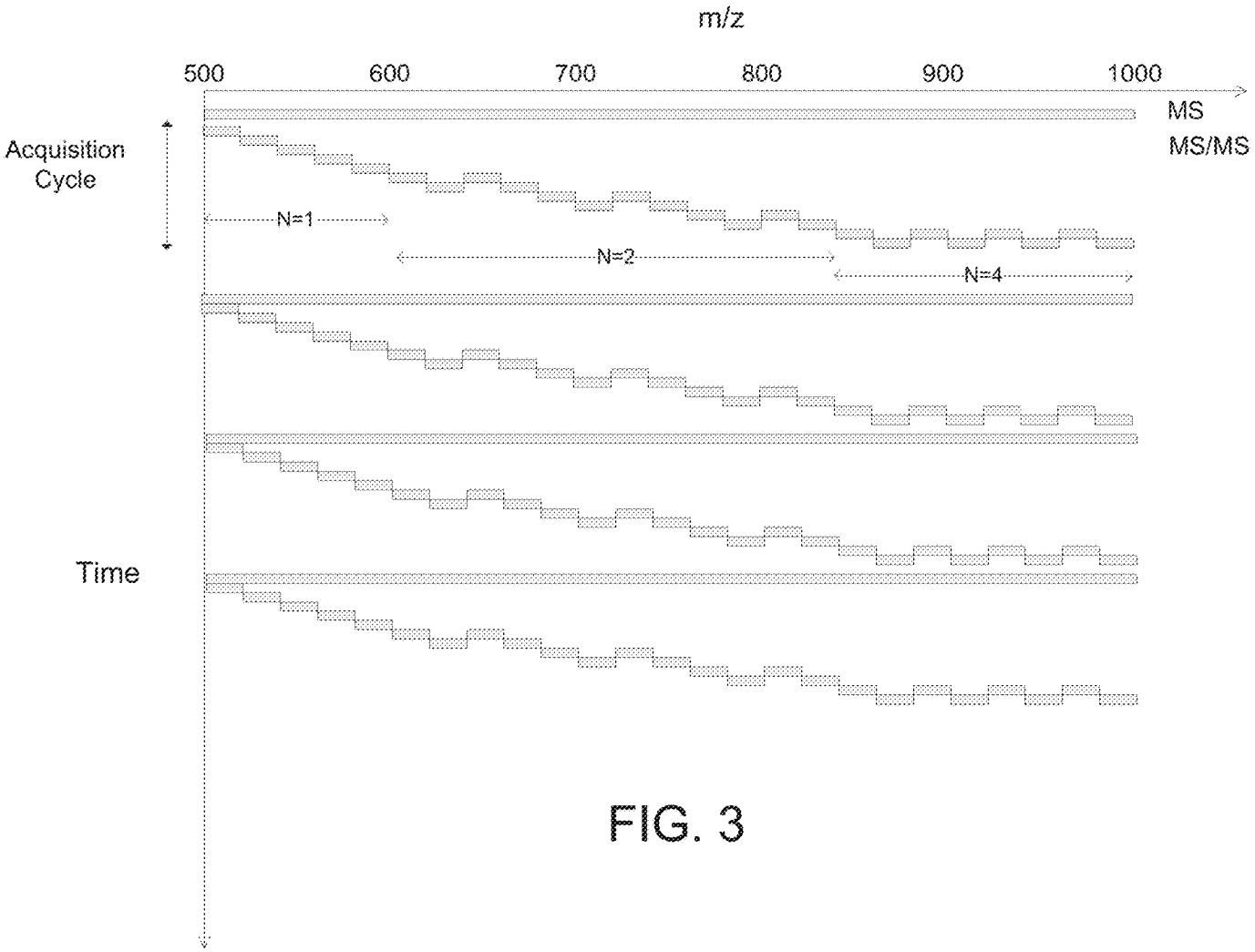
FIG. 3 depicts a data acquisition cycle in accordance with an illustrative embodiment of the present invention, wherein the number N of concurrently analyzed isolation windows is varied across the data acquisition cycle.

As noted above, MS/MS spectra for product ions generated from a relatively large number of disparate precursor ion species tend to be complex and difficult to interpret and process. This challenge is addressed in the mDIA technique by varying, at least once within a DIA cycle, the number of isolation windows N that are concurrently analyzed in an MS/MS scan (via combining the product ions corresponding to all of the N isolation windows prior to acquiring the MS/MS spectrum). This variation in N is illustrated in FIG. 3, which depicts a series of acquisition cycles performed across a 500-1000 Th precursor ion range with isolation windows of 20 Th. As with conventional DIA acquisition cycles, the isolation windows extend in the aggregate across the entire precursor mass range of interest, such that all precursor ions lying within that range of m/z's are fragmented at least once within an acquisition cycle. The 500-1000 Th precursor ion range of interest is divided into three subranges. In the 500-600 Th subrange, a multiplexing degree of N=1 (equivalent to no multiplexing) is used; a separate MS/MS spectrum is acquired for product ions derived from each isolation window. In the 600-840 Th subrange, a multiplexing degree of N=2 is used, wherein product ions from two different isolation windows are combined and analyzed together for acquisition of an MS/MS spectrum. For example, the product ions corresponding to the 600-620 Th and 640-660 Th isolation windows are combined and subjected to concurrent mass analysis in the mass analyzer, then the product ions corresponding to the 620-640 Th and 660-680 Th isolation windows are combined and subjected to concurrent mass analysis, and so on. Finally, in the 840-1000 Th subrange, a multiplexing degree of N=4 is used, wherein product ions from four different isolation windows are combined and collectively analyzed together in the MS/MS spectrum. For example, the product ions corresponding to the 840-860 Th, 880-900 Th, 920-940 Th and 960 Th isolation windows are combined together and subjected to concurrent mass analysis, then the product ions corresponding to the 860-880 Th, 900-920 Th, 940-960 Th and 980-1000 Th isolation windows are combined together and concurrently mass analyzed. In the preferred implementation shown in FIG. 3, the windows that are multiplexed together in an MS/MS scan are disjoint (non-contiguous) in m/z space. However, in other implementations, m/z-adjacent (contiguous) windows may be multiplexed together. For certain implementations, the isolation windows that are combined when N is set to 2 or greater are selected in a randomized fashion from the set of isolation windows in the corresponding sub-range that have yet to be subjected to an isolation/fragmentation sequence. It should be noted that while the isolation windows are depicted herein as being discrete and non-overlapping, certain implementations may utilize isolation windows that overlap in their m/z range; for example, a first isolation window may extend from 499-521 Th, a second window may extend from 519-541 Th, a third window may extend from 539-561 Th, and so on. It should be further noted that while the isolation windows depicted in FIG. 3 and described above are of fixed width across the acquisition cycle (20 Th in the example), alternative implementations may utilize isolation windows of variable widths.

As discussed above and depicted in the drawing, each acquisition cycle may be initiated by acquisition of a survey (MS only) scan over the entire precursor range of interest, whereby the m/z's and intensities of all (unfragmented) precursor ions are determined before commencing the MS/MS events.

In various implementations of the invention, the precursor ion mass range of interest over which the data acquisition cycle is performed may have a width of at least 100 Th, at least 200 Th, at least 500 Th, or at least 1000 Th. The plurality of isolation windows in the data acquisition cycle may include at least 5, at least 10, at least 20, or at least 50 isolation windows. Each of the isolation windows may have a width of at least 2 Th, at least 3 Th, at least 5 Th, at least 10 Th, or at least 20 Th.

It should be further appreciated that while three different values of N (1, 2 and 4) are employed in the acquisition cycle of FIG. 3, this number was selected for illustrative purpose only, and that implementations of the invention may vary N any number of times greater than 1, i.e., N may be varied 1, 2, 3, 4, 5 or more than 5 times across the acquisition cycle. It is still further noted that while the precursor mass range of interest is divided in the foregoing example into 25 windows of 20 Th width, these numbers are provided by way of an illustrative example, and other implementations may utilize any suitable numbers of windows and isolation window widths.

The multiplexing scheme for an acquisition cycle, i.e., the number of subranges and the degree of multiplexing within each range, will generally be selected (either automatically through computer control, or manually or semi-manually through user input) in view of the expected or known density of precursor ion species across the range of interest. This information may be obtained or inferred by examination of previously acquired mass spectra, or by knowledge of the nature of the sample and its components. In some implementations, the multiplexing scheme may be determined and set on-the-fly via processing of the initial MS scan, which produces a mass spectrum of precursor ions in the range of interest. In such an implementation, the control/data system may determine the prevalence of precursor ions in different regions of the spectrum, and select the number of concurrently analyzed isolation windows based on this information. For regions of the precursor m/z range of interest in which a relatively large number of precursor ion species (or precursor ion species of particular interest) are known or expected to be present, it is preferable to set the multiplexing degree to a low number (e.g., N=1) in order to avoid producing undesirably complex MS/MS spectra. Conversely, the degree of multiplexing can be set to a relatively high number (e.g., N=4) in regions where precursor ion species are sparsely populated.

The multiplexing scheme may be fixed across an entire chromatographic run, or may instead by dynamically adjusted in chromatographic time, for example to account for expected variations in the precursor ion distribution as components elute from a column.

The multiplexing scheme used for a data acquisition cycle is stored in memory such that each MS/MS spectra is indexed to the isolation window(s) of the precursors that produced the corresponding product ions. This information is required for spectral deconvolution and product-to-precursor ion mapping, as well as quantification of identified molecules in the sample.

Those skilled in the art will recognize that the methods described above may be utilized for analysis of a broad range of sample types (including both biological samples and non-biological samples) and for a wide variety of applications, including but not limited to proteomics, metabolomics, environmental analysis and food safety. The substances analyzed by the methods disclosed herein may consist of, for example, proteins, peptides, lipids, metabolites, pesticides, drugs of abuse, or therapeutic agents.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method of analyzing ions by mass spectrometry, comprising:

repeatedly executing a data acquisition cycle to acquire product ion data across a precursor ion mass range of interest, the data acquisition cycle including performing, for each of a plurality of isolation windows having different mass ranges, steps of: isolating precursor ions within the mass range of the isolation window, fragmenting the precursor ions to generate product ions and mass analyzing the product ions;

wherein the plurality of isolation windows collectively span the precursor ion mass range of interest, and wherein the step of mass analyzing the product ions comprises concurrently mass analyzing product ions corresponding to N isolation windows, N being an integer≥1, and N being varied at least once across the data acquisition cycle.

2. The method of claim 1, wherein N is varied at least twice across the data acquisition cycle.

3. The method of claim 1, wherein all of the plurality of isolation windows have the same width.

4. The method of claim 1, wherein at least two of the plurality of isolation windows have widths different from each other.

5. The method of claim 1, wherein, for portions of the data acquisition cycle where N≥2, at least one of the isolation windows is disjoint with respect to all others of the N concurrently analyzed isolation windows.

6. The method of claim 1, where at least two of the plurality of isolation windows overlap.

7. The method of claim 1, wherein N≥3 for at least a portion of the data acquisition cycle.

8. The method of claim 1, wherein, for portions of the data acquisition cycle where N≥2, precursor ions of each of the N concurrently analyzed isolation windows are separately fragmented and subsequently combined.

9. The method of claim 1, wherein, for portions of the data acquisition cycle where N≥2, precursor ions of the N concurrently analyzed isolation windows are fragmented together.

10. The method of claim 1, wherein for portions of the data acquisition cycle where N≥2, the N concurrently analyzed isolation windows are selected in a randomized manner.

11. The method of claim 1, wherein the plurality of isolation windows includes at least 10 isolation windows.

12. The method of claim 1, wherein each of the isolation windows has a width of at least 5 Th.

13. The method of claim 1, wherein the variation of N across the data acquisition cycle is set by the operator.

14. The method of claim 1, wherein the variation of N across the data acquisition cycle is set automatically based on previously acquired data.

15. The method of claim 1, wherein the data acquisition cycle includes a step of conducting a survey scan to mass analyze the precursor ions across the precursor mass range of interest.

16. A mass spectrometer, comprising:

an ionization source for generating ions from a sample;

a mass selector for selecting precursor ions within an isolation window for fragmentation;

a collision cell positioned to receive the selected precursor ions from the mass selector and adapted to cause the received precursor ions to undergo fragmentation to form product ions;

a mass analyzer positioned to receive product ions from the collision cell and to mass analyze the product ions; and a data/control system programmed to repeatedly execute a data acquisition cycle to acquire product ion data across a precursor ion mass range of interest, the data acquisition cycle including performing, for each of a plurality of isolation windows having different mass ranges, steps of: isolating precursor ions within the mass range of the isolation window, fragmenting the precursor ions to generate product ions and mass analyzing the product ions;

wherein the plurality of isolation windows collectively span the precursor ion mass range of interest, and wherein the step of mass analyzing the product ions comprises concurrently mass analyzing product ions corresponding to N isolation windows, N being an integer≥1, and N being varied at least once across the data acquisition cycle.

17. The mass spectrometer of claim 16, further comprising an ion store located downstream of the collision cell configured to accumulate product ions corresponding to multiple isolation windows.

18. The mass spectrometer of claim 16, wherein the mass selector comprises a quadrupole mass filter.

19. The mass spectrometer of claim 16, wherein the control/data system is programmed to vary N at least twice across the data acquisition cycle.

* * * * *